US005911217A

United States Patent [19]

Dameworth et al.

[11] Patent Number: 5,911,217

[45] Date of Patent: Jun. 15, 1999

[54] INTERNALLY MOUNTED FLUE DAMPER WITH EXTERIOR FREE-STANDING DAMPER DRIVE

[75] Inventors: William D. Dameworth, Hartsville; Gary S. Threatt, Kershaw, both of S.C.

[73] Assignee: AOS Holding Comnpany, Wilmington, Del.

[21] Appl. No.: 08/861,419

[22] Filed: May 21, 1997

[51] Int. Cl.[6] ..... F24H 1/00

[52] U.S. Cl. ..... 126/344; 126/285 R; 126/285 B; 236/1 G

[58] Field of Search ..... 126/285 R, 285 A, 126/286, 297, 307 A, 350 R, 364, 365, 312, 344; 122/17, 44.2; 431/20; 236/1 G

[56] References Cited

U.S. PATENT DOCUMENTS

| | | | |
|---|---|---|---|
| 1,698,563 | 1/1929 | Robb | 128/285 R |
| 1,711,365 | 4/1929 | Summers | 126/285 R |
| 1,991,557 | 2/1935 | Johnson | 122/14 |
| 2,224,705 | 12/1940 | Stringer | 126/285 |
| 2,443,359 | 6/1948 | Newhouse | 236/20 |
| 4,205,783 | 6/1980 | Dietsche et al. | 236/1 |
| 4,251,024 | 2/1981 | Feinberg | 236/1 |
| 4,262,652 | 4/1981 | Butzen | 126/285 |
| 4,389,014 | 6/1983 | Chow | 236/1 |
| 4,421,096 | 12/1983 | Butzen | 126/285 |
| 4,846,400 | 7/1989 | Crouse | 236/93 |
| 5,239,947 | 8/1993 | Schimmeyer | 122/17 |

*Primary Examiner*—James C. Yeung
*Attorney, Agent, or Firm*—Michael Best & Friedrich LLP

[57] ABSTRACT

This invention provides a water heater including a water storage tank, a flue, a jacket around the tank and the flue and having a top end, a top cover which extends over the tank and the flue and which closes the jacket top end, and a flue collector within the top cover and having an exhaust opening within the top cover and in communication with the flue. The water heater further includes a flue damper mechanism comprising a damper disk pivotally mounted within the flue collector exhaust opening so that the disk can pivot between a closed position closing the exhaust opening and an open position opening the exhaust opening, and drive means for pivoting the damper disk. The drive means comprises a damper actuator exterior of the top cover, a mounting tube secured to the flue collector and secured to the damper actuator, and a damper shaft within the mounting tube and extending between the damper actuator and the damper disk.

20 Claims, 2 Drawing Sheets

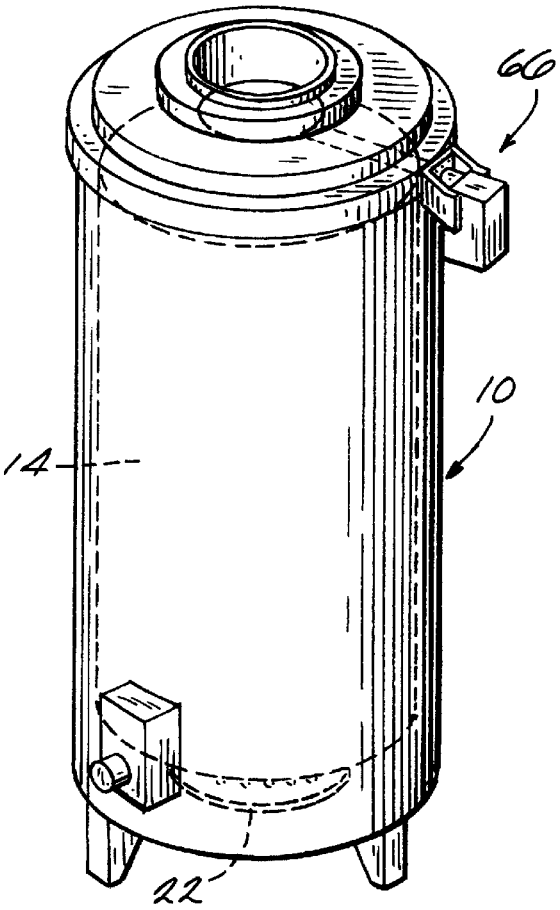
Fig. 1
Fig. 5
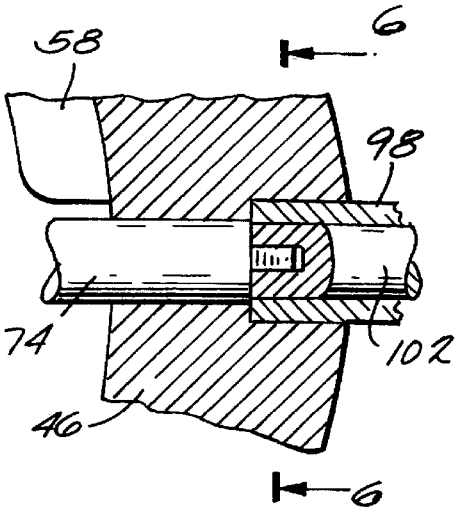
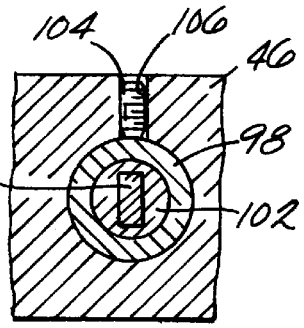
Fig. 6
Fig. 4
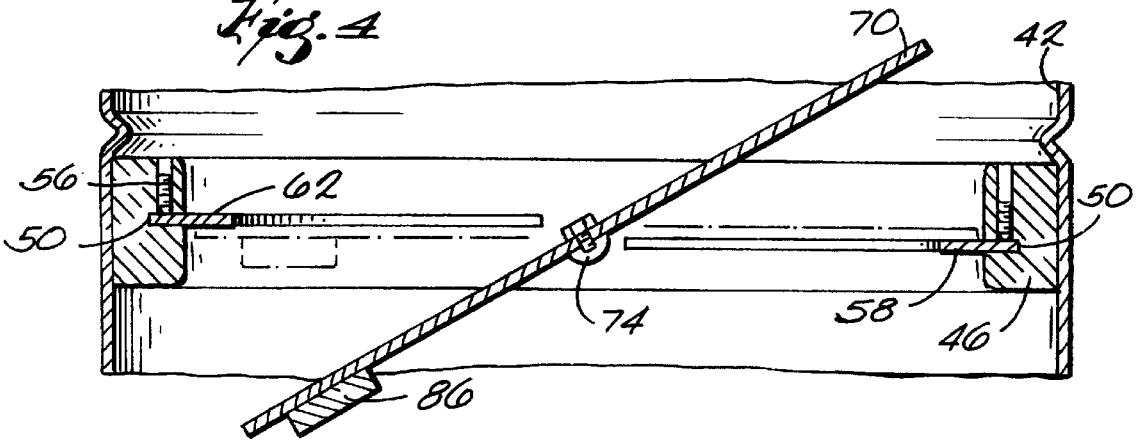

INTERNALLY MOUNTED FLUE DAMPER WITH EXTERIOR FREE-STANDING DAMPER DRIVE

BACKGROUND OF THE INVENTION

This invention relates to gas combustion water heaters and, more particularly, to methods of restricting the air flow through the water heater flue when the water heater combustion system is not operating.

SUMMARY OF THE INVENTION

This invention provides a water heater including a water storage tank, a flue, a jacket around the tank and the flue and having a top end, a top cover which extends over the tank and the flue and which closes the jacket top end, and a flue collector within the top cover and having an exhaust opening within the top cover and in communication with the flue. The water heater further includes a flue damper mechanism comprising a damper disk pivotally mounted within the flue collector exhaust opening so that the disk can pivot between a closed position closing the exhaust opening and an open position opening the exhaust opening, and drive means for pivoting the damper disk. The drive means comprises a damper actuator exterior of the top cover, a mounting tube fixed relative to the flue collector and fixed relative to the damper actuator, and a damper shaft within the mounting tube and extending between the damper actuator and the damper disk.

In one embodiment, the mounting tube is mounted between the top cover and the tank, and the flue damper mechanism further comprises an annular flue damper casting which is concentric with and located within the flue collector. The flue damper mechanism further comprises the casting having a circumferential slot in the interior wall of the casting, and a choke ring removably received in the casting circumferential slot.

One of the principal features of the invention is providing an improved damper drive mechanism which is more aesthetically pleasing than the prior art approaches.

Another of the principal features of the invention is the use of a damper drive mechanism which is received within the top cover of the water heater and thus is less susceptible to damage.

Other features and advantages of the invention will become apparent to those skilled in the art upon review of the following detailed description, claims and drawings.

DESCRIPTION OF THE DRAWINGS

FIG. 1 is a perspective view of a water heater with a flue damper mechanism which embodies various of the features of this invention.

FIG. 4 is a partial cross section of the annular flue damper casting and choke ring taken along the line 4—4 in FIG. 3.

FIG. 5 is a cross sectional view showing the connection of the mounting tube to the flue damper casting.

FIG. 6 is a cross sectional view of the casting as shown in FIG. 5 taken along the line 6—6 in FIG. 5 illustrating the means by which the mounting tube is secured to the flue damper casting.

Figure 3:
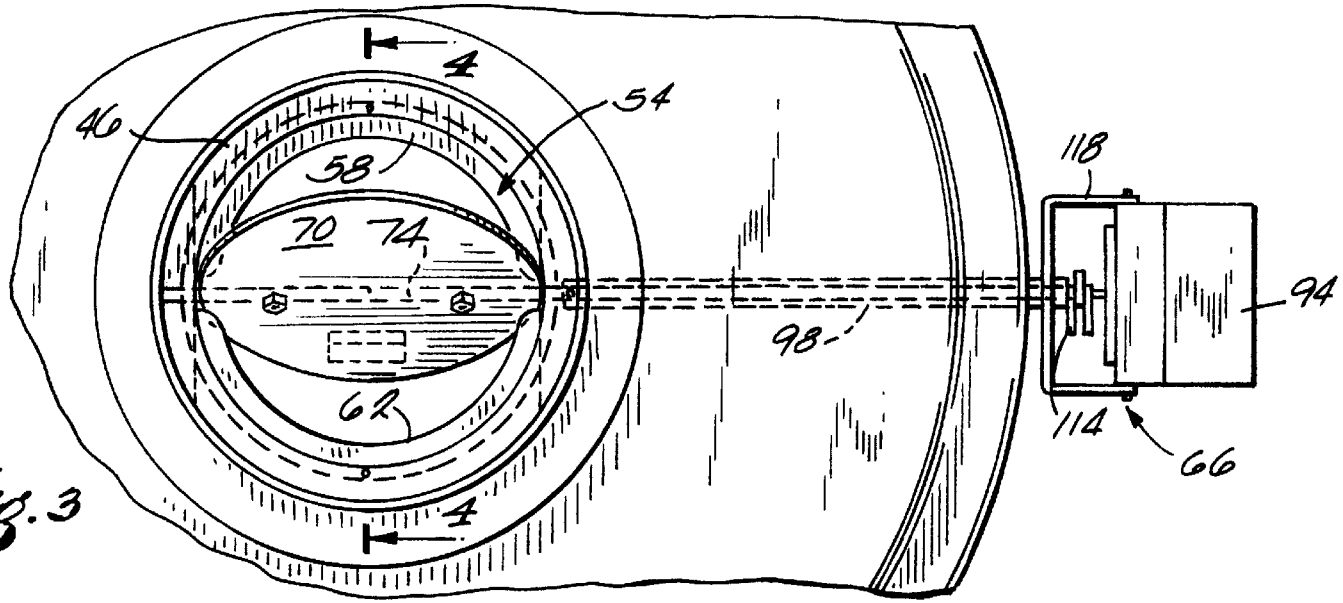
FIG. 3 is a partial top view of the water heater and flue damper mechanism illustrated in FIG. 1.
Figure 2:
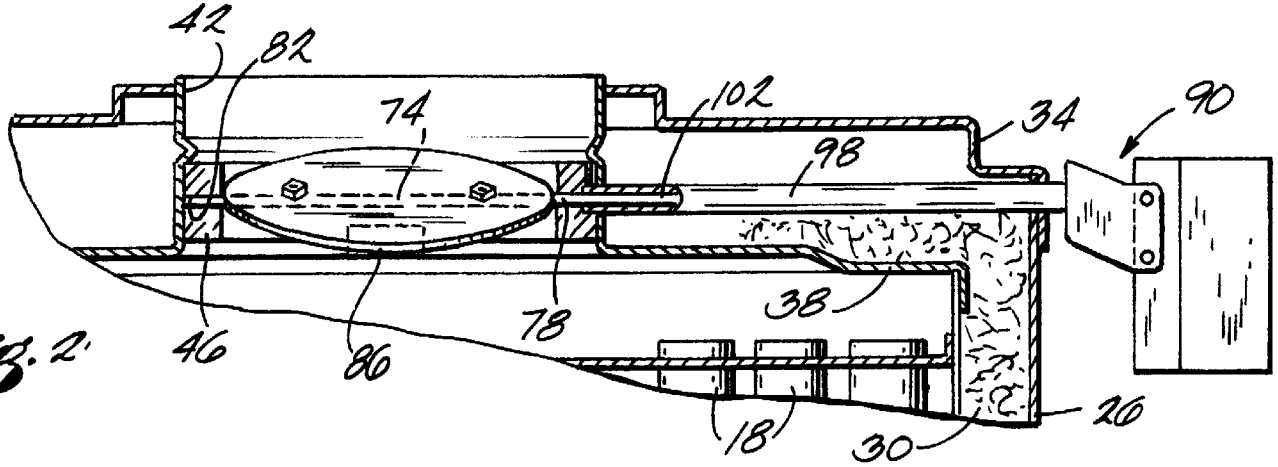
FIG. 2 is a partially broken away side view of the top of the water heater showing the flue damper mechanism as illustrated in FIG. 1.

Before one embodiment of the invention is explained in detail, it is to be understood that the invention is not limited in its application to the details of the construction or the arrangements of the components set forth in the following description or illustrated in the drawings. The invention is capable of other embodiments, and of being practiced or of being carried out in various ways. Also, it is to be understood that the phraseology and terminology used herein is for the purpose of description and should not be regarded as limiting.

DESCRIPTION OF A PREFERRED EMBODIMENT OF THE INVENTION

As illustrated in the drawings, this invention is a water heater 10 including a water storage tank 14, one or more flues 18 which pass through the tank 14, and a natural gas combustion system 22 underneath the tank 14. The exhaust from the combustion of the natural gases passes through the flue 18, heating the water in the water storage tank 14. The water storage tank 14 is surrounded by a jacket 26. As is conventional in the art, the space between the jacket and the tank is filled with insulation 30.

The water heater 10 includes a top cover 34 which extends over the water heater tank 14, which covers the end of the flue 18, and which closes the top end of the jacket 26. Located within the top cover 34 above the water storage tank is a flue collector 38. The flue collector 38 gathers the exhaust from the flues 18 and directs the flue exhaust to an exhaust opening 42. The exhaust opening 42 is within the top cover 34 and is more specifically defined by a flue collector extension ring which is received within an opening in the top cover 34.

Located within the flue collector extension ring 42 is an annular flue damper casting 46 typically constructed of cast iron. The flue damper casting 46 is annular in shape and includes a circumferential slot 50 in the interior wall of the casting. Receivable within this circumferential slot 50, as more particularly illustrated in FIGS. 3 and 4, is a choke ring 54. The choke ring 54 is removably received in the slot 50 and, in the preferred embodiment, is comprised of two choke ring segments 58 and 62. Choke ring segments of various widths can be used in order to vary the amount of flue restriction caused by the choke ring 54. The choke ring segments are held in the slot 50 with two set screws 56.

The water heater 10 further includes a flue damper mechanism 66 comprising the flue damper casting 46, the choke ring 54 and a damper disk 70. The damper disk 70 is pivotally mounted within the casting 46 so that the disk 70 can pivot between a closed position completely closing the flue exhaust opening 42, and an open position completely opening the flue exhaust opening 42. The damper disk 70 is pivotally mounted within the casting by means of a post 74 which extends through the center of the disk 70 and is received in an opening 78 in one side of the casting and mounted in an opening 82 in the opposite other end of the casting 46. The damper disk 70 further includes a fail-safe counterweight 86 mounted on the damper disk 70.

The flue damper mechanism 66 further includes a drive means 90 for pivoting the damper disk 70. The drive means 90 comprises a damper actuator 94 exterior of the top cover 34, a mounting tube 98 secured to the casting 46 and secured to the damper actuator 94, and a damper shaft 102 within the mounting tube 98 and extending between the damper actuator 94 and the damper disk 70. More particularly, the mounting tube 98 is mounted between the top cover 34 and tank 14. As illustrated in greater detail in FIG. 6, the mounting tube 98 is secured to the casting by means of a pin 104 which is received in a slot 106 in the casting 46 and which engages the mounting tube 98. The damper shaft 102 is secured to the post 74 which pivots the damper disk 70, as illustrated in FIGS. 5 and 6. Located between the damper actuator 94 and the damper shaft 102 is a coupler 114, as is conventional in the art. A mounting bracket 118 further supports the drive actuator 94 relative to the mounting tube 98 and is secured to the damper drive 94 and to the mounting tube 98.

When the damper disk 70 is mounted within the casting 46, the damper disk 70 may only pivot in one direction. More particularly as viewed from FIGS. 3 and 4, the top portion of the disk 70 is above the first choke ring segment 58 and the bottom portion of the disk 70 is below the second choke ring segment 62. Accordingly, the damper disk 70 can only pivot forward and back because of the location of the damper disk 70 relative to the choke ring segments 58 and 62, respectively.

The providing of the damper actuator 94 radially outwardly of the top cover 34 aids in wiring the damper actuator 94 to an appropriate control circuit and helps remove the damper actuator 94 from the heat found around the exhaust opening 42.

Various of the features of the invention are set forth in the following claims.

What is claimed is:

1. A water heater including a water storage tank, a flue, a jacket around said tank and said flue and having a top end, a top cover which extends over said tank and said flue and which closes said jacket top end, a flue collector within said top cover and having an exhaust opening within the top cover and in communication with said flue, and a flue damper mechanism comprising a damper disk pivotally mounted within the flue collector exhaust opening so that the disk can pivot between a closed position closing the exhaust opening and an open position opening the exhaust opening, and drive means for pivoting the damper disk, the drive means comprising a damper actuator exterior the top cover, a mounting tube fixed relative to the flue collector and fixed relative to and supporting the damper actuator, and a damper shaft within the mounting tube and extending between the damper actuator and the damper disk.

2. A water heater in accordance with claim 1 wherein said mounting tube is mounted between the top cover and the tank.

3. A water heater in accordance with claim 1 wherein said flue damper mechanism further comprises an annular flue damper casting which is concentric with and located within the flue collector.

4. A water heater in accordance with claim 3 wherein said flue damper mechanism further comprises the casting having a circumferential slot in the interior wall of the casting, and a choke ring removably received in the casting circumferential slot.

5. A water heater in accordance with claim 1 wherein said damper actuator is supported radially outward of said jacket by said mounting tube.

6. A water heater including a water storage tank, a flue, a jacket around said tank and said flue and having a top end, a top cover which extends over said tank and said flue and which closes said jacket top end, a flue collector within said top cover and having an exhaust opening within the top cover and in communication with said flue, and a flue damper mechanism comprising:

an annular flue damper casting which is concentric with and located within the flue collector, the casting having a circumferential slot in the interior wall of the casting, a damper disk pivotally mounted within the casting so that the disk can pivot between a closed position completely closing the exhaust opening and a open position completely opening the exhaust opening, a choke ring removably received in the casting circumferential slot, and drive means for pivoting the damper disk, the drive means comprising a damper actuator exterior of the top cover, a mounting tube secured to the casting and secured to the damper actuator, and mounted between the top cover and the tank, and a damper shaft within the mounting tube and extending between the damper actuator and the damper disk.

7. A water heater in accordance with claim 6 wherein said damper actuator is supported radially outward of said jacket by said mounting tube.

8. A water heater including a water storage tank, a flue, a jacket around said tank and said flue and having a top end, a top cover which extends over said tank and said flue and which closes said jacket top end, a flue collector within said top cover and having an exhaust opening within the top cover and in communication with said flue, and a flue damper mechanism comprising an annular flue damper casting which is concentric with and located within the flue collector, the casting having a circumferential slot in the interior wall of the casting, and a choke ring removably received in the casting circumferential slot, a damper disk pivotally mounted within the flue collector exhaust opening so that the disk can pivot between a closed position closing the exhaust opening and an open position opening the exhaust opening, drive means for pivoting the damper disk, the drive means comprising a damper actuator exterior the top cover, a mounting tube fixed relative to the flue collector and fixed relative to the damper actuator, and a damper shaft within the mounting tube and extending between the damper actuator and the damper disk.

9. A water heater in accordance with claim 8 wherein said mounting tube is mounted between the top cover and the tank.

10. A water heater in accordance with claim 8 wherein said damper actuator is supported radially outward of said jacket by said mounting tube.

11. A water heater in accordance with claim 8 wherein the damper disk is mounted within the casting.

12. A water heater in accordance with claim 11 wherein the choke ring is comprised of two generally semi-circular segments, and wherein the damper disk engages the choke ring segments when the damper disk is in the closed position.

13. A water heater including a water storage tank, a flue, a jacket around said tank and said flue and having a top end, a top cover which extends over said tank and said flue and which closes said jacket top end, a flue collector within said top cover and having an exhaust opening within the top cover and in communication with said flue, and a flue damper mechanism comprising a damper disk pivotally mounted within the flue collector exhaust opening so that the disk can pivot between a closed position closing the exhaust opening and an open position opening the exhaust opening, and drive means for pivoting the damper disk, the drive means comprising a damper actuator mounted exterior of the top cover and radially outward of the jacket, and a damper shaft extending between the damper actuator and the damper disk.

14. A water heater in accordance with claim 13 further comprising a mounting tube fixed relative to the flue collector and fixed relative to and supporting the damper actuator, wherein the damper shaft extends within said mounting tube.

15. A water heater in accordance with claim 14 wherein said mounting tube is mounted between the top cover and the tank.

16. A water heater in accordance with claim 13 wherein said flue damper mechanism further comprises an annular flue damper casting which is concentric with and located within the flue collector.

17. A water heater in accordance with claim 16 wherein said flue damper mechanism further comprises the casting having a circumferential slot in the interior wall of the casting, and a choke ring removably received in the casting circumferential slot.

18. A water heater in accordance with claim 17 wherein the damper disk is mounted within the casting.

19. A water heater in accordance with claim 18 wherein the choke ring is comprised of two generally semi-circular segments, and wherein the damper disk engages the choke ring segments when the damper disk is in the closed position.

20. A water heater in accordance with claim 7 wherein the mounting tube supports the damper actuator, wherein the choke ring is comprised of two generally semi-circular segments, and wherein the damper disk engages the choke ring segments when the damper disk is in the closed position.

* * * * *